US012257621B2

(12) United States Patent
Pederzoli

(10) Patent No.: US 12,257,621 B2
(45) Date of Patent: Mar. 25, 2025

(54) MOLDING SYSTEM

(71) Applicant: MECCANICA PI.ERRE S.R.L. DI PEDERZOLI RUGGERO & C., Bedizzole (IT)

(72) Inventor: Ruggero Pederzoli, Bedizzole (IT)

(73) Assignee: MECCANICA PI.ERRE S.R.L. DI PEDERZOLI RUGGERO & C., Bedizzole (IT)

( * ) Notice: Subject to any disclaimer, the term of this patent is extended or adjusted under 35 U.S.C. 154(b) by 0 days.

(21) Appl. No.: 17/928,944

(22) PCT Filed: Sep. 28, 2021

(86) PCT No.: PCT/IB2021/058846
§ 371 (c)(1),
(2) Date: Dec. 1, 2022

(87) PCT Pub. No.: WO2022/074510
PCT Pub. Date: Apr. 14, 2022

(65) Prior Publication Data

US 2023/0234124 A1 Jul. 27, 2023

(30) Foreign Application Priority Data

Oct. 8, 2020 (IT) ..... 102020000023728

(51) Int. Cl.
*B22D 17/26* (2006.01)
*B22D 17/22* (2006.01)
(Continued)

(52) U.S. Cl.
CPC ..... *B22D 17/263* (2013.01); *B22D 17/2236* (2013.01); *B22D 17/32* (2013.01); *B22D 18/04* (2013.01)

(58) Field of Classification Search
CPC .. B22D 17/263; B22D 17/2236; B22D 17/32; B22D 18/04
See application file for complete search history.

(56) References Cited

U.S. PATENT DOCUMENTS 5,102,327 A 4/1992 Reinhart
6,170,558 B1 * 1/2001 Giolo ..... B22D 18/04 164/337

(Continued)

FOREIGN PATENT DOCUMENTS

WO 2020012264 A1 1/2020

OTHER PUBLICATIONS

International Search Report, issued in PCT/IB2021/058846, mailed Nov. 2, 2021, Rijswijk, NL.

*Primary Examiner* — Kevin P Kerns
*Assistant Examiner* — Steven S Ha
(74) *Attorney, Agent, or Firm* — ArentFox Schiff LLP; Michael Fainberg

(57) ABSTRACT

A molding system for a low-pressure light alloy casting plant, extending in height along a main axis, has a mold having a lower half-mold and an upper half-mold. The molding system has a first lower fixed plate on which the lower half-mold is housed, a movable plate on which the upper half-mold is housed, a second upper fixed plate positioned at the top of the movable plate, a movement group for moving the movable plate along the main axis, having an electric drive motor and transmission members operatively connected to the electric drive motor and to the movable plate, a casting ejection group having an electric ejector motor and ejection members movable by the electric ejector motor in an ejection position in which the casting is (Continued)

detached from the upper half-mold, and a command unit controlling operation of the electric drive motor and of the electric ejector motor.

8 Claims, 6 Drawing Sheets

(51) Int. Cl.
*B22D 17/32* (2006.01)
*B22D 18/04* (2006.01)

(56) References Cited

U.S. PATENT DOCUMENTS

2004/0050528 A1* 3/2004 Zajber ..... B22D 11/053
164/478
2018/0133786 A1* 5/2018 Amezawa ..... B22D 17/32

* cited by examiner

MOLDING SYSTEM

CROSS-REFERENCE TO RELATED APPLICATIONS

This application is a National Phase Application of PCT International Application No. PCT/IB2021/058846, having an International Filing Date of Sep. 28, 2021 which claims priority to Italian Application No. 102020000023728 filed Oct. 8, 2020, each of which is hereby incorporated by reference in its entirety.

FIELD OF THE INVENTION

The present invention relates to a specific molding system for molding light-alloy castings obtained by means of a low-pressure casting process. In particular, the present invention also relates to a low-pressure light alloy casting plant which comprises said molding system.

In the present discussion, the term "casting" refers to the product obtained by molding. In other words, the "casting" is the product obtained following the injection of molten metal inside the mold and following the solidification of said molten metal. Typically, the "casting" also includes a series of portions, necessary for the optimal success of the casting operations that are subsequently to be eliminated: sprues, cast runners, wells, vacuum branches, foundry burrs and/or the like. These operations are carried out on special machines or special plants not covered by the present discussion.

In the present discussion, "light alloy" means metal alloys of aluminum, magnesium, zinc, etc.

Furthermore, in the present discussion, low-pressure light alloy casting means that production mode in which the light alloy in the molten state is injected into the mold at an indicative pressure of about 1-2 bar, preferably proximal to 1 bar.

In accordance with the above, therefore, the features of the casting plant and of the molding system subject of the present invention are therefore a function of the features of the light alloy, for example its temperature, its viscosity, its cooling times, and its injection forces.

The "castings" obtained by means of said casting plants are therefore components with structural mechanical features which typically have application in the automotive world.

BACKGROUND OF THE INVENTION

In the prior art, a plurality of molding system solutions, sometimes known as "presses", are known. In the known solutions there are molds, typically in two or more parts, known as half-molds or shells. These parts, half-molds or shells, are placed in a working position and in an open position. In the working position the mold is closed: at first the molten metal is injected inside and at a second time one waits for the molten metal to solidify, thus obtaining the "casting." In the open position, the parts of the mold are instead open and the "casting" is therefore extractable in such a way as to allow the execution of a new cycle.

In the prior art, innumerable embodiments of molding systems are known wherein the control and movement actions of the mold take place by means of specific hydraulic drives.

On the other hand, hydraulic drives exhibit a series of problems. For example, it should be emphasized that hydraulic drives have uncontrollable movements: in fact, hydraulic plants only allow the positioning of a component in two positions, a position induced by the presence of the hydraulic action and a position induced by the lack of hydraulic action.

The need is therefore strongly felt to obviate this problem, i.e. the need is strongly felt to have a molding system in which the position of the various components is instead fully controllable.

SUMMARY OF THE INVENTION

The object of the present invention is to provide a molding system which fulfills the aforesaid requirements falling within the specific context of low-pressure light alloy casting molding operations.

This object is achieved by a molding system and a low-pressure light alloy casting plant as described and claimed herein. Preferred embodiments involving advantageous aspects are also described.

BRIEF DESCRIPTION OF THE DRAWINGS

The object of the present invention is described in detail hereafter, with the aid of the accompanying drawings, in which.

DETAILED DESCRIPTION

Figure 1:
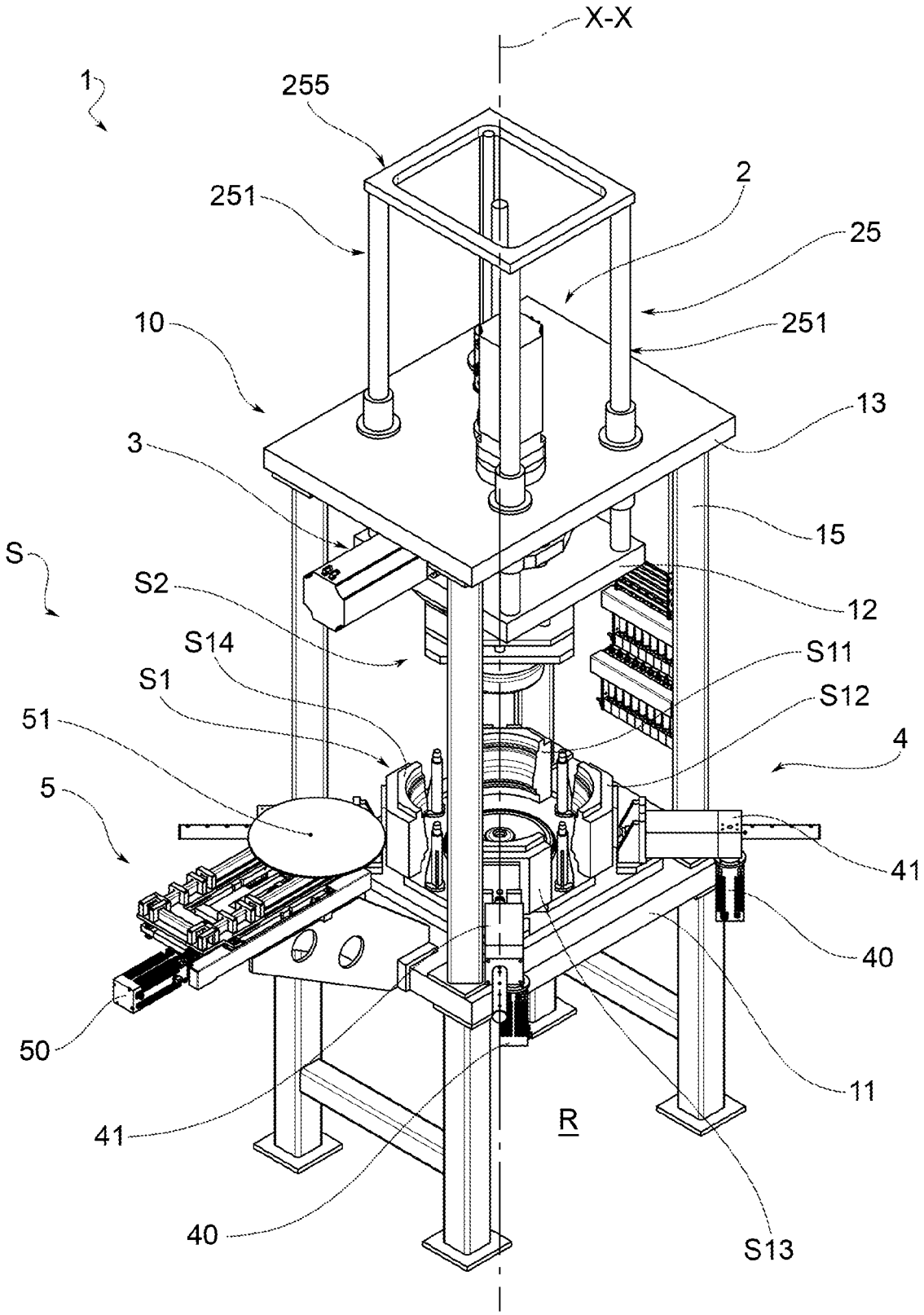
FIG. 1 shows a perspective view of the molding system object of the present invention, in an open configuration, according to a preferred embodiment.
Figure 2B:
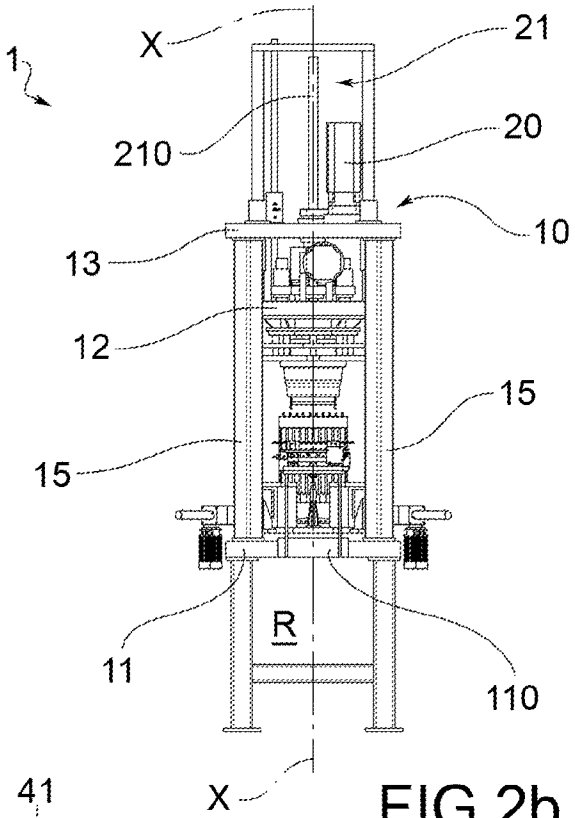
FIGS. 2*a*, 2*b* and 2*c* show a side view, a front view and a top view, respectively, of the molding system of FIG. 1.
Figure 2C:
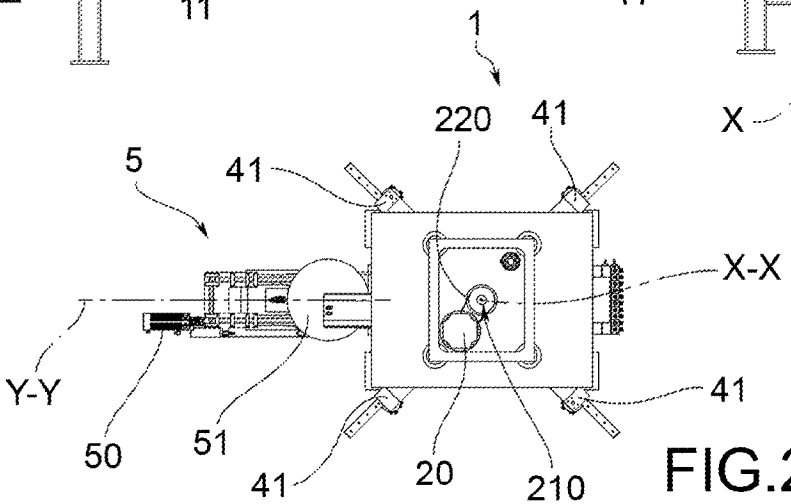
Figure 2A:
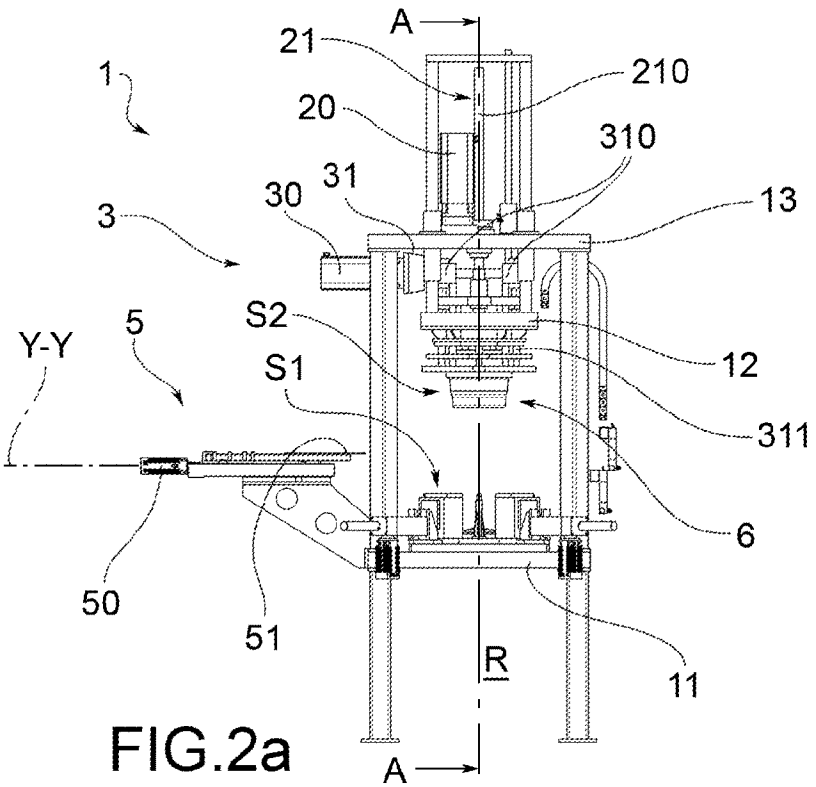
Figure 3:
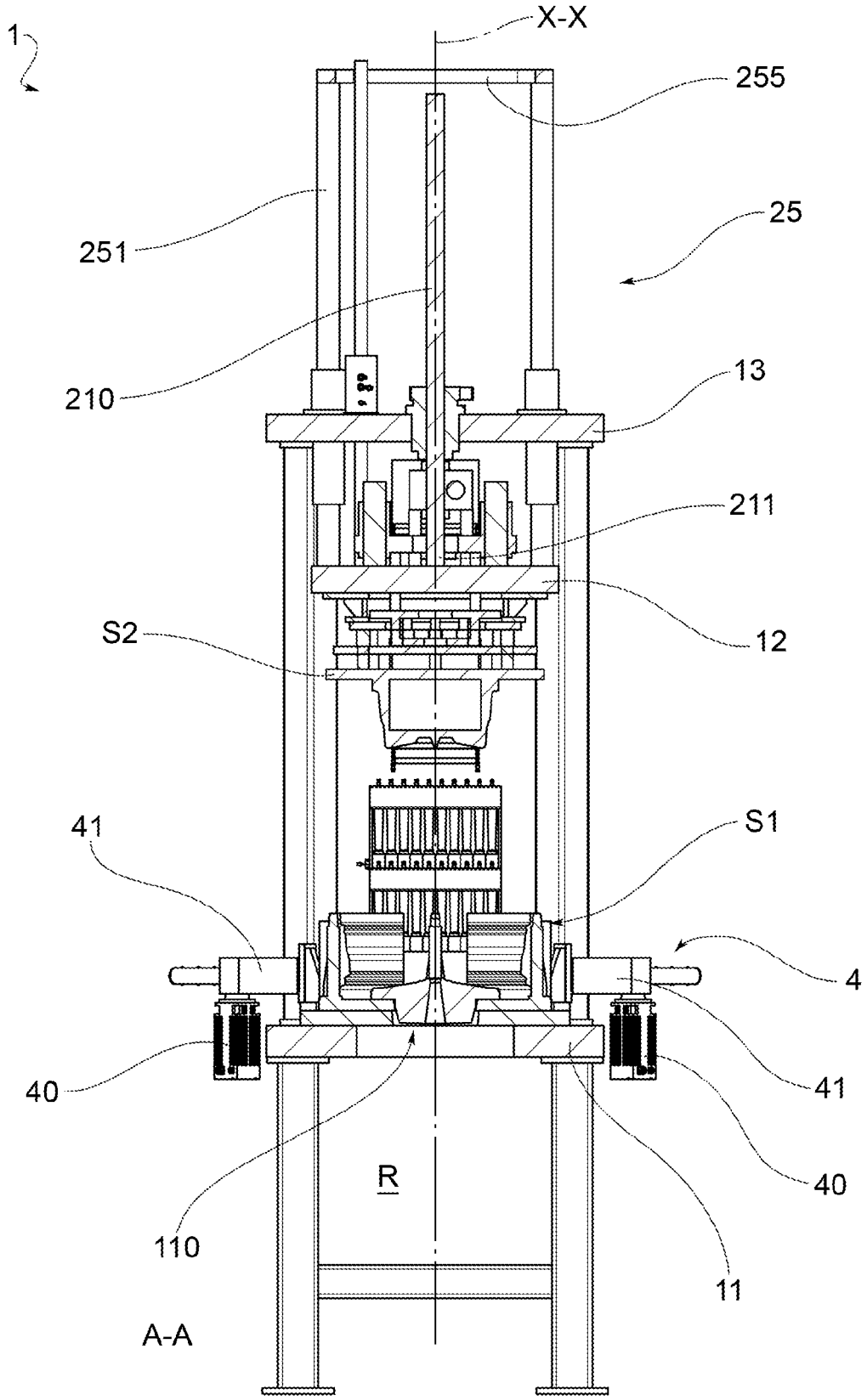
FIG. 3 shows a sectional view of the molding system according to the section plane A-A of FIG. 2*a;*
Figure 4:
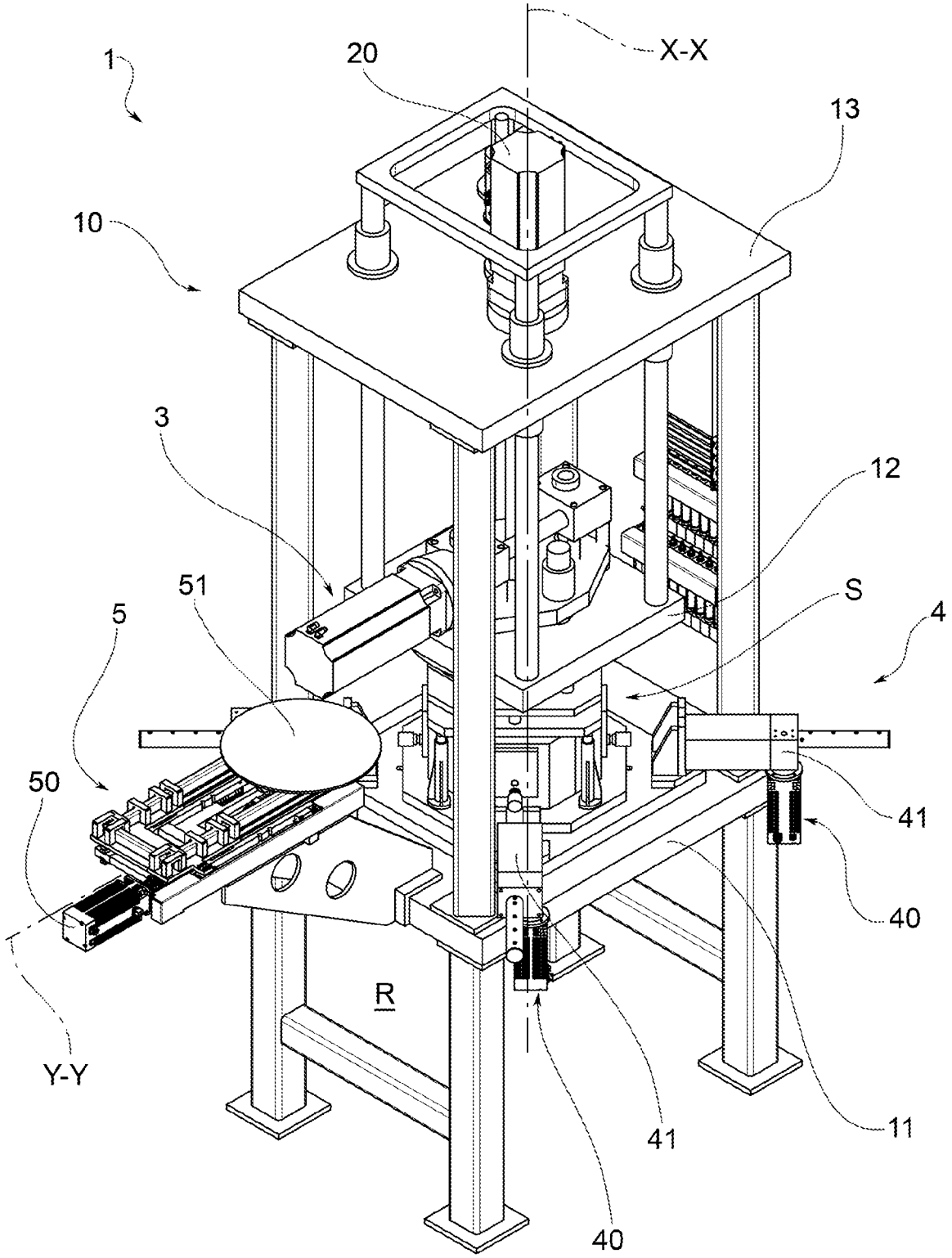
FIG. 4 shows a perspective view of the molding system object of the present invention, in a working or closed configuration, according to a preferred embodiment.
Figure 5B:
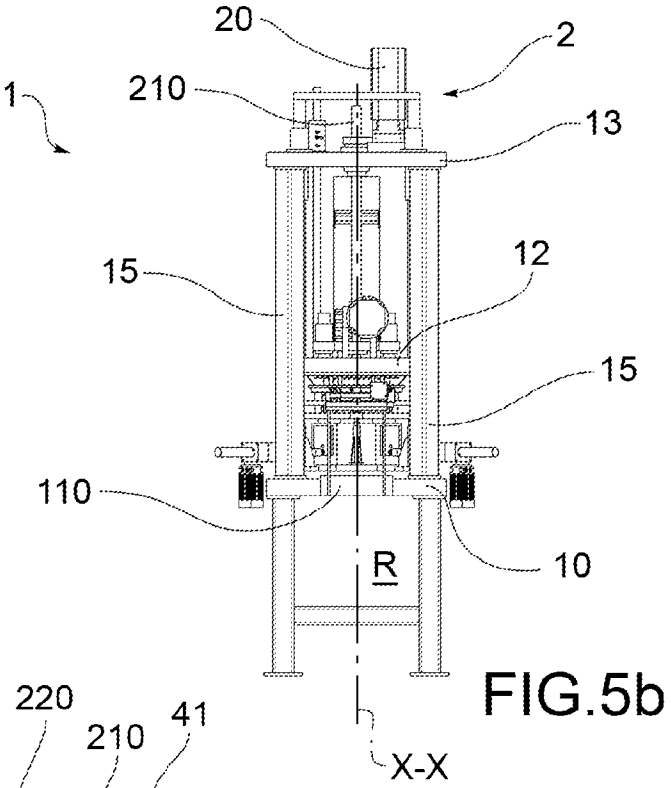
FIGS. 5*a*, 5*b* and 5*c* show a side view, a front view and a top view, respectively, of the molding system of FIG. 4.
Figure 5C:
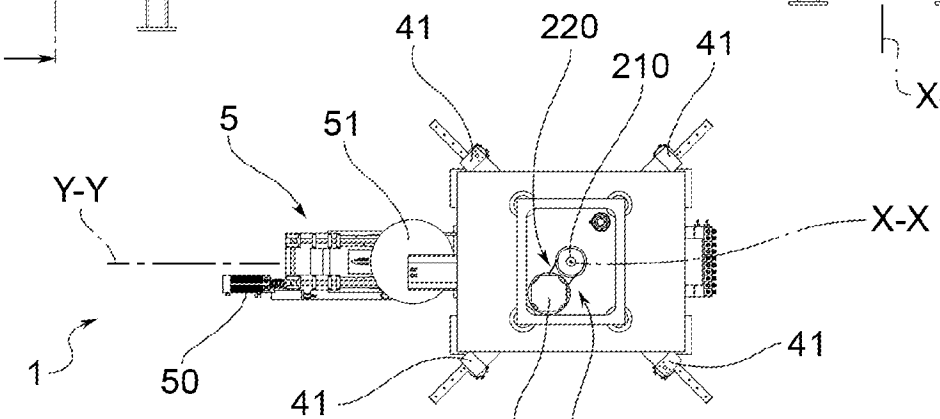
Figure 5A:
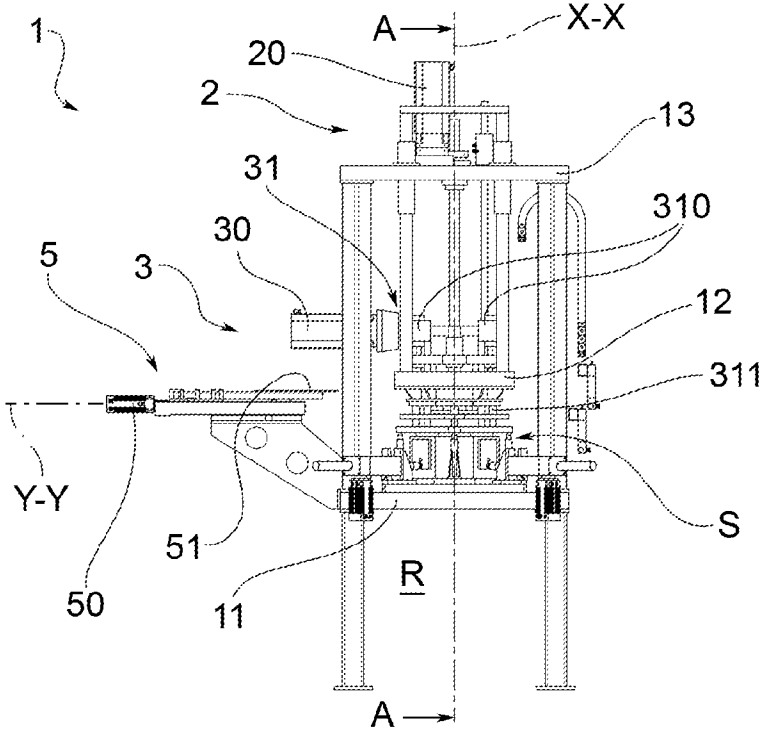
Figure 6:
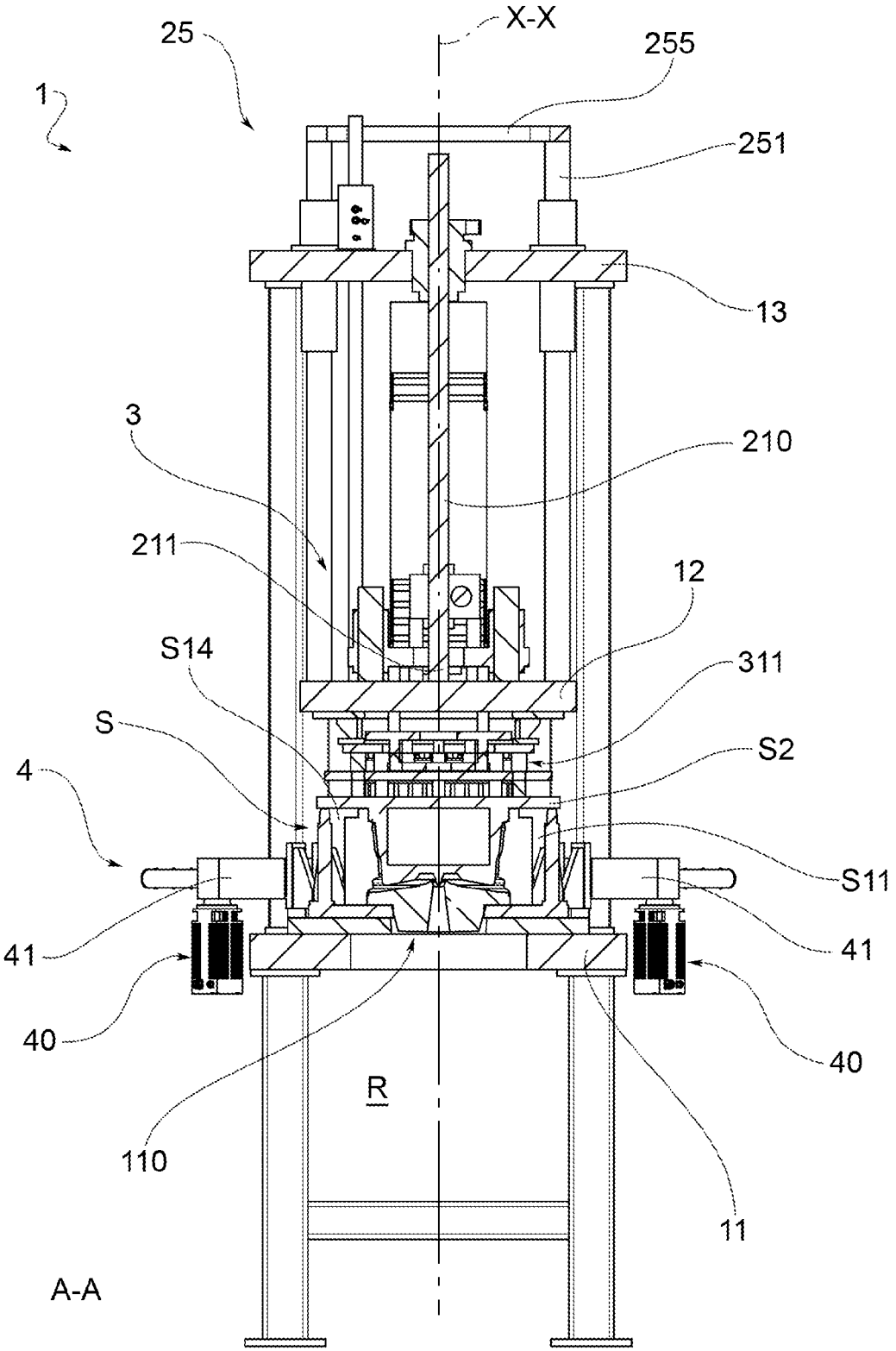
FIG. 6 illustrates a sectional view of the molding system according to the section plane A-A of FIG. 5*a*.

With reference to the above figures, reference numeral 1 denotes, in its entirety, the molding system 1 subject of the present invention.

The molding system 1 is specific for being part of a low-pressure light alloy casting plant which is itself the subject of the present invention. Said low-pressure casting plant also comprises a light alloy casting-injection system fluidly connectable to the casting system 1.

In particular, the casting system 1 extends in height along a main axis X-X and comprises a base region R positioned at the bottom in which the light alloy casting-injection system is at least partially housable.

Furthermore, in which the molding system 1 comprises and moves, as described in detail below, a mold S.

In particular, the mold S comprises a lower half-mold S1 and an upper half-mold S2 which are reciprocally positionable between a working position, or a closed position, in which they are mutually engaged and in a plurality of open positions in which they are mutually axially spaced along the main axis X-X.

Preferably, one half-mold is fixed, while the other is moved in translation.

Preferably, as fully described below, the movable half-mold is positionable in a plurality of axial positions.

Furthermore, according to a preferred embodiment, the lower half-mold S1 comprises a plurality of slider elements S11, S12, S13, S14 which are positionable in a closed half-mold position and in at least one open half-mold position. Preferably, said slider elements S11, S12, S13, S14 are movable radially with respect to the main axis X-X translating between a closed half-mold position in which they are proximal to the main axis X-X and a plurality of open half-mold positions in which they are distal from main axis X-X.

According to a preferred embodiment, as may be seen from the following description, the molding system 1 has a preferred application in the creation of substantially axially symmetrical shaped castings such as for example alloy wheels of vehicles.

According to the present invention, the molding system 1 comprises a first fixed plate 11, a movable plate 12 and a second fixed plate 13.

Preferably, the molding system 1 comprises a main structure 10 which comprises said plates 11, 12, 13.

According to a preferred embodiment, the first fixed plate 11 and the second fixed plate 13 are mutually joined together by support beams 15 included in the main structure 10. Preferably, the support beams 15 are positioned mutually angularly equidistant from each other. Preferably, the support beams 15 are four in number.

According to the present invention, the first fixed plate 11 is the lower plate, which is proximal to the base plane. Said first fixed plate 11 delimits the base region R with the base plane.

The lower half-mold S1 is housed on the first fixed plate 11.

Furthermore, the first fixed plate 11 and the lower half-mold S1 are fluidly connectable to the casting-injection system. Preferably, in fact, on the first fixed plate 11 there is a fluidic passage 110 through which molten metal flows to reach the mold S. According to a preferred embodiment, said fluidic passage 110 is of a material with a high melting point, for example comprising an injector made of ceramic material.

On the movable plate 12, on the other hand, the upper half-mold S2 is housed. The axial position of the movable plate 12 corresponds to an axial position of the upper half-mold S2.

Finally, the second fixed plate 13 is positioned above. The second fixed plate 13 is positioned at the top of the movable plate 12.

In other words, the movable plate 12 is housed between the two fixed plates and between the support beams 15 which join them integrally.

According to the present invention, the molding system 1 comprises a movement group 2 suitable for moving the movable plate 12 along the main axis X-X between a working position, in which the mold S is closed, and a multiplicity of raised positions in which the upper half-mold S2 is separated from the lower half-mold S1.

The movement group 2 comprises an electric drive motor 20 housed on the second fixed upper plate 13 and transmission members 21 operatively connected to the electric drive motor 20 and to the movable plate 12 suitable for transforming the rotary motion of the electric drive motor 20 in translational motion.

According to a preferred embodiment, the electric drive motor 20 is of the brushless type.

Furthermore, according to a preferred embodiment, the transmission members 21 comprise a worm screw element 210 comprising a thrust end 211 engaged with the movable plate 12.

Preferably, the electric drive motor 20 engages and rotates said worm screw element 210, causing the movable plate 12 to be translated along the main axis X-X.

According to a preferred embodiment, moreover, the transmission members 21 further comprise a connecting element 220, preferably a belt or a chain, suitable for connecting the electric drive motor 20 to the worm screw element 210.

According to a preferred embodiment, the worm screw element 210 is positioned on the main axis X-X.

Preferably, the worm screw element 210 crosses the second fixed plate 13 to allow the translation of the movable plate 12 and its engagement with the electric drive motor 20.

According to a preferred embodiment, the movement group 2 also comprises a support structure 25 engaged with the movable plate 12 and traversing the second fixed plate 13. Preferably, the support structure 25 has the purpose of supporting and keeping the movable plate 12 in position.

According to a preferred embodiment, the support structure 25 comprises a plurality of guide elements 251 and which extend, parallel to the main axis X-X, through the second fixed plate 13. Preferably, the support structure 25 also comprises a base frame 255 for supporting the guide elements 251. In other words, the guide elements 251 extend between the movable plate 12 and the base frame 255. Preferably, the support structure 25 translates together with the movable plate 12.

According to the present invention, moreover, the molding system 1 also comprises a casting ejection group 3, housed on the movable plate 12. The casting ejection group 3 has the purpose of carrying out an action on the casting by means of which it is detached from the upper half-mold S2.

Said casting ejection group 3 comprises an electric ejector motor 30 and ejection members 31 operatively connected to the electric ejector motor 30, to the movable plate 12, and to the upper half-mold S2, movable by the electric ejector motor 30 in an ejection position in which the casting is detached from the upper half-mold S2.

Preferably, the electric ejector motor 30 is of the brushless type.

Preferably, said ejection members 31 comprise one or more mechanical jacks 310 controlled by the action of the electric ejector motor 30. The movement of said mechanical jack 310 involves the axial movement of specific thrust pins 311 suitable for protruding and engage in thrust the casting causing the detachment thereof from the upper half-mold S2.

Preferably, the ejection members 31 comprise two mechanical jacks 310.

According to a preferred embodiment, the molding system 1 comprises a lower half-mold opening-closing group 4 comprising for each slider element S11, S12, S13, S14, a respective electric slider motor 40.

Preferably, the movement of each electric slider motor 40 involves the opening and closing of the lower half-mold S1. In particular, the lower half-mold opening-closing group 4 comprises, for each slider element S11, S12, S13, S14, a respective command jack 41 operatively connected to the respective slider element and to the respective electric slider motor 40.

According to a preferred embodiment, the molding system 1 also comprises a casting collection group 5, that is a group of components which allows the collection of the casting detached from the upper half-mold S2 by the action of the casting ejection group 3.

Preferably, the casting collection group 5 comprises a collection plate 51 suitable for translating along a collection axis Y-Y transversal to the main axis X-X.

Moreover, the casting collection group 5 comprises an electric collection motor 50 operatively connected to the collection plate 51 to move it to an advanced position, in which the collection plate 51 is positioned at the main axis X-X, and to a retracted position, in which the collection plate 51 is spaced apart from the main axis X-X.

Preferably, the electric collection motor 50 is a brushless motor.

According to a preferred embodiment, the electric collection motor 50 is commanded in drive with the purpose of controlling the drive and therefore the translation of the collection plate 51 into the advanced position corresponding to a raised position of the movable plate 12 and of the upper half-mold S2.

According to a preferred embodiment, the actuation of the casting ejection group 3 and the consequent detachment of the casting from the upper half-mold S2 is carried out only once the collection plate 51 is positioned in an advanced position.

According to the present invention, the molding system 1 comprises a command unit, operatively connected to the movement group 2 and to the casting ejection group 3, suitable for commanding the operation of the electric drive motor 20 and of the electric ejector motor 30.

According to a preferred embodiment, the command unit is operatively connected also with the lower half-mold opening-closing group 4.

According to a preferred embodiment, the command unit is also operatively connected to the casting collection group 5.

According to the present invention, the command unit is operatively connected to the respective electric motors comprised in the respective groups to which it is operatively connected. Preferably, the command unit is suitable for controlling the drives of said electric motors.

According to a preferred embodiment, the command unit controls the drive of the electric ejector motor 30 simultaneously with the drive of the electric drive motor 20. In other words, the command unit controls the casting ejection action during the lifting operations of the upper plate. Preferably, said command is performed following the positioning of the collection plate 51 in an advanced position.

According to a preferred embodiment, the command unit is suitable for controlling the start of the lifting of the movable plate 12, starting from the working position, as soon as the opening of the slider elements S11, S12, S13, S14 is commanded.

According to the present invention, some movements are commanded by the command unit at a determined speed while other movements are commanded at a different speed.

According to a preferred embodiment, the operating modes of the command unit are configurable according to requirements. For example, preferably, the strokes of the movable parts included in the molding system 1 are a function of the size and type of mold S and casting. Similarly, the command unit carries out the control actions of the electric motors, and then carries out the movements, according to the size and type of mold S and casting.

According to a preferred embodiment, once certain positions have been reached, the command unit is suitable for controlling the switching off of the respective electric motors. According to a preferred embodiment, the electric motors controlled to be switched off remain in torque and therefore maintain their position. For example, the command unit is suitable for controlling the switching off of the electric slider motors 40 once the slider elements have been positioned in the closed lower half-mold position. For example, the command unit is suitable for controlling the switching off of the electric drive motor 20 once the movable plate 12 has been positioned in the working position.

According to a preferred embodiment, the molding system 1 further comprises heat shields suitable for protecting the electric motors from the heat produced by the light alloy casting-injection system.

Preferably, the heat shields comprise primary shields positioned on the first fixed plate 11, on the movable plate 12 and on the second fixed plate 13.

Preferably, the heat shields comprise secondary shields placed about the electric motors.

According to the above, it should be noted that when reference is made to electric motors this refers to components which comprise the drive part, for example comprising stator-rotor, and the command part, for example comprising a command board. Preferably, the command unit is operatively connected to each command board.

Innovatively, the molding system object of the present invention is suitable for fully meeting the intended object.

Advantageously, the molding system subject of the present invention has electrically moved components, obviating the need for hydraulic devices.

Advantageously, the presence of hydraulic supply pipes or conduits, valve groups for hydraulic management, filter groups for cleaning the hydraulic oil, oil tanks and the like is avoided. Advantageously, the molding system is therefore extremely simplified.

Advantageously, the molding system subject of the present invention is adjustable according to the needs and according to the specific dimensions and geometries of the mold and/or of the casting obtained or to be obtained.

Advantageously, the movement speed is considerably greater than in known solutions as it is a function of the torques of the present electric motors.

Advantageously, the speed of the movements, the dimensions of the strokes, and the timing in accordance with which they are performed, are specifically configurable according to the needs of the mold and of the casting.

Advantageously, all the execution times of the activities are optimizable, having a cycle time that is significantly lower than that of solutions of molding systems of the prior art of the hydraulic type.

Advantageously, some of the described movements are performable simultaneously with each other.

Advantageously, the cycle times downstream of the light alloy injection and cooling operations are optimized.

Advantageously, the molding system subject of the present invention is extremely safe and reliable.

Advantageously, the molding system subject of the present invention is extremely compact.

Advantageously, the molding system subject of the present invention has extremely low consumption.

Advantageously, the molding system subject of the present invention has a minimal or even zero environmental impact compared to known solutions.

Advantageously, the molding system subject of the present invention requires minimal maintenance, unlike the known hydraulic solutions, thus providing for a minimum number, and in some cases zero, of "machine stops"

Advantageously, the molding system object of the present invention allows the achievement of high production capacities.

A person skilled in the art may make several changes or replacements of elements with other functionally equivalent ones to the embodiments of the molding system in order to meet specific needs. Also, such variants are included within the scope of protection as defined by the following claims.

Moreover, each variant described as belonging to a possible embodiment may be implemented independently of the other variants described.

The invention claimed is:

1. A molding system for a low-pressure light alloy casting plant comprising a light alloy casting-injection system, wherein the molding system extends in height along a main axis and comprises a base region positioned at a bottom, in which the light alloy casting-injection system is at least partially housable, wherein the molding system comprises a mold comprising a lower half-mold and an upper half-mold, wherein the molding system further comprises:

a lower fixed plate, on which the lower half-mold is housed, wherein the lower fixed plate and the lower half-mold are fluidly connectable to the light alloy casting-injection system;

a movable plate on which the upper half-mold is housed;

an upper fixed plate, positioned at a top of the movable plate;

a movement group suitable for moving the movable plate along the main axis between a working position, in which the mold is closed, and a multiplicity of raised positions in which the upper half-mold is separated from the lower half-mold, the movement group comprising:

an electric drive motor housed on the upper fixed plate; and transmission members operatively connected to the electric drive motor and to the movable plate suitable for transforming rotary motion of the electric drive motor into translational motion;

a casting ejection group, housed on the movable plate, comprising:

an electric ejector motor;

ejection members operatively connected to the electric ejector motor, to the movable plate, and to the upper half-mold, the ejection members being movable by the electric ejector motor in an ejection position in which a casting is detached from the upper half-mold;

a command unit, operatively connected to the movement group and to the casting ejection group, suitable for commanding operation of the electric drive motor and of the electric ejector motor; and a casting collection group comprising:

a collection plate suitable for translating along a collection axis transversal to the main axis; and an electric collection motor operatively connected to the collection plate to move the collection plate to an advanced position, in which the collection plate is positioned at the main axis, and to a retracted position, in which the collection plate is spaced apart from the main axis.

2. The molding system of claim 1, wherein the command unit is operatively connected to the electric collection motor to command operation of the electric collection motor and translation of the collection plate to the advanced position corresponding to a raised position of the movable plate and of the upper half-mold.

3. The molding system of claim 2, wherein the command unit is suitable for commanding operation of the casting ejection group once the collection plate is positioned in the advanced position.

4. A molding system for a low-pressure light alloy casting plant comprising a light alloy casting-injection system, wherein the molding system extends in height along a main axis and comprises a base region positioned at a bottom, in which the light alloy casting-injection system is at least partially housable, wherein the molding system comprises a mold comprising a lower half-mold and an upper half-mold, wherein the molding system further comprises:

a lower fixed plate, on which the lower half-mold is housed, wherein the lower fixed plate and the lower half-mold are fluidly connectable to the light alloy casting-injection system;

a movable plate on which the upper half-mold is housed;

an upper fixed plate, positioned at a top of the movable plate;

a movement group suitable for moving the movable plate along the main axis between a working position, in which the mold is closed, and a multiplicity of raised positions in which the upper half-mold is separated from the lower half-mold, the movement group comprising:

an electric drive motor housed on the upper fixed plate; and transmission members operatively connected to the electric drive motor and to the movable plate suitable for transforming rotary motion of the electric drive motor into translational motion;

a casting ejection group, housed on the movable plate, comprising:

an electric ejector motor;

ejection members operatively connected to the electric ejector motor, to the movable plate, and to the upper half-mold, the ejection members being movable by the electric ejector motor in an ejection position in which a casting is detached from the upper half-mold; and a command unit, operatively connected to the movement group and to the casting ejection group, suitable for commanding operation of the electric drive motor and of the electric ejector motor, wherein the lower half-mold comprises a plurality of slider elements positionable in a closed half-mold position and in an open half-mold position, wherein the molding system comprises a lower half-mold opening-closing group comprising a respective electric slider motor for each slider element of the plurality of slider elements.

5. The molding system of claim 4, wherein the command unit is operatively connected to each electric slider motor to command operation thereof and opening and closing of the lower half-mold.

6. The molding system of claim 5, wherein the lower half-mold opening-closing group comprises, for each slider element, a respective command jack operatively connected to the respective slider element and to the respective electric slider motor.

7. A molding system for a low-pressure light alloy casting plant comprising a light alloy casting-injection system, wherein the molding system extends in height along a main axis and comprises a base region positioned at a bottom, in which the light alloy casting-injection system is at least partially housable, wherein the molding system comprises a mold comprising a lower half-mold and an upper half-mold, wherein the molding system further comprises:

a lower fixed plate, on which the lower half-mold is housed, wherein the lower fixed plate and the lower half-mold are fluidly connectable to the light alloy casting-injection system;

a movable plate on which the upper half-mold is housed;

an upper fixed plate, positioned at a top of the movable plate;

a movement group suitable for moving the movable plate along the main axis between a working position, in which the mold is closed, and a multiplicity of raised positions in which the upper half-mold is separated from the lower half-mold, the movement group comprising:

an electric drive motor housed on the upper fixed plate; and transmission members operatively connected to the electric drive motor and to the movable plate suitable for transforming rotary motion of the electric drive motor into translational motion;

a casting ejection group, housed on the movable plate, comprising:

an electric ejector motor;

ejection members operatively connected to the electric ejector motor, to the movable plate, and to the upper half-mold, the ejection members being movable by the electric ejector motor in an ejection position in which a casting is detached from the upper half-mold;

a command unit, operatively connected to the movement group and to the casting ejection group, suitable for commanding operation of the electric drive motor and of the electric ejector motor; and heat shields for protecting the electric motors from heat produced by the light alloy casting-injection system, wherein the heat shields comprise primary shields positioned on the lower fixed plate, on the movable plate, and on the upper fixed plate.

8. The molding system of claim 7, wherein the heat shields further comprise secondary shields placed about the electric motors.

* * * * *